US008721007B2

(12) United States Patent
In 'T Hout

(10) Patent No.: US 8,721,007 B2
(45) Date of Patent: May 13, 2014

(54) HIGHWALL MINING SYSTEM, CONVEYOR SEGMENT AND METHOD FOR PROVIDING SUCH A MINING SYSTEM

(75) Inventor: Cornelis Wilhelm In 'T Hout, Gouda (NL)

(73) Assignee: Caterpillar Global Mining Highwall Miners LLC, Beckley, WV (US)

( * ) Notice: Subject to any disclaimer, the term of this patent is extended or adjusted under 35 U.S.C. 154(b) by 1321 days.

(21) Appl. No.: 11/572,464

(22) PCT Filed: Jul. 20, 2004

(86) PCT No.: PCT/NL2004/000518

§ 371 (c)(1),
(2), (4) Date: Sep. 17, 2007

(87) PCT Pub. No.: WO2006/009423

PCT Pub. Date: Jan. 26, 2006

(65) Prior Publication Data

US 2008/0197690 A1 Aug. 21, 2008

(51) Int. Cl.
*E21F 1/06* (2006.01)
*E21F 13/00* (2006.01)

(52) U.S. Cl.
USPC ..... 299/64; 299/18; 299/12

(58) Field of Classification Search
USPC ..... 299/64, 18, 10, 12
See application file for complete search history.

(56) References Cited

U.S. PATENT DOCUMENTS

| | | | | |
|---|---|---|---|---|
| 3,802,578 | A * | 4/1974 | Farnworth | 213/76 |
| 4,323,280 | A * | 4/1982 | Lansberry et al. | 299/1.4 |
| 5,273,344 | A * | 12/1993 | Volkwein et al. | 299/12 |
| 5,820,223 | A | 10/1998 | Marshall et al. | 299/12 |
| 5,967,616 | A | 10/1999 | Offutt et al. | 299/30 |
| 5,997,100 | A * | 12/1999 | Marshall et al. | 299/12 |
| 6,030,244 | A * | 2/2000 | Buckheit et al. | 439/291 |
| 2001/0022464 | A1 | 9/2001 | Seear | 299/56 |

FOREIGN PATENT DOCUMENTS

| | | |
|---|---|---|
| GB | 897 257 A | 5/1962 |
| GB | 1 156 799 A | 7/1969 |

* cited by examiner

*Primary Examiner* — John Kreck
(74) *Attorney, Agent, or Firm* — Foley & Lardner LLP

(57) ABSTRACT

The invention relates to a highwall mining system comprising: a cutterhead (2), a train of conveyor segments (6) connecting to the cutterhead (2), a base structure (5), and a gas guide (P1-P4) running from the base structure (5) to the cutterhead (2) for guiding inert gas to the environment of the cutterhead (2). The invention also relates to a conveyor segment (6) for use in a such a highwall mining system, and to a method for providing this highwall mining system.

12 Claims, 4 Drawing Sheets

Figure 1:
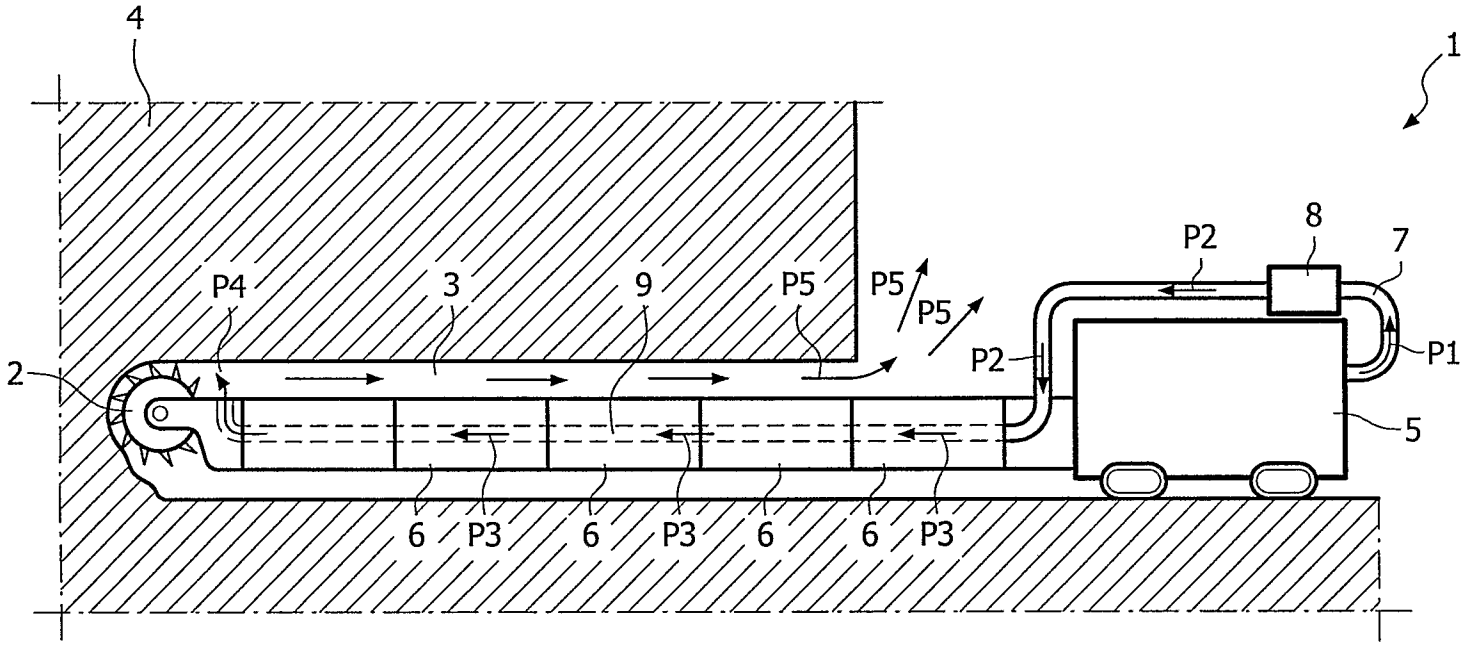

HIGHWALL MINING SYSTEM, CONVEYOR SEGMENT AND METHOD FOR PROVIDING SUCH A MINING SYSTEM

This application is a national phase of International Application No. PCT/NL2004/000518 filed Jul. 20, 2004 and published in the English language.

The invention relates to a highwall mining system comprising: a cutterhead, a train of conveyor segments connecting to the cutterhead, a base structure (launch platform and power unit) connecting to the train of conveyor segments opposite the side connecting to the cutterhead, and a gas guide running from the base structure to the cutterhead for guiding inert gas to the environment of the cutterhead. The invention also relates to a conveyor segment for use in a train of conveyor segments of a highwall mining system, and to a method for providing a highwall mining system that creates a substantially inert atmosphere for a cutterhead of the mining system, by providing a channel from an exhaust of a combustion engine that is a part of a base structure (as an integral part or as an individual part) of the mining system to the environment of the cutterhead, which cutterhead is separated from the base structure by a train of conveyor segments.

Highwall mining is conducted for removing coal, or minerals, ores or other materials in seams or veins under an overburden which may be accessed from an exposed edge of the seam or vein. Highwall mining is applicable where the appropriate machinery can be placed in a cut or bench to extend a cutterhead, followed by a train of conveyor segments or units as the cutterhead advances, into a substantially horizontal shaft under the overburden. The conveyor segments are also known as push beams, as they are not self-propelled; rather they are pushed into the mine. Each conveyor segment has transporting means like one or more screw conveyors ("augers"), conveyor belts, or chain/scraper conveyors to move coal from its lead end to its rear end and further onto the next rearward conveyor segment, and to the launch bed ultimately. The screw conveyors, conveyor belts or chain/scraper conveyors can be powered by shafts connected from one conveyor segment to the next, ultimately turned by a motor on the launch vehicle, by a separate power generating unit that is connected to the launch vehicle or by a motor at the cutterhead end of the train. An area of concern for highwall mining is the possibility of explosions (from organic compounds like e.g. methane and coal dust) generated in the mining process.

An inertization system for highwall mining is described in U.S. Pat. No. 5,820,233. The system comprises circulation means located adjacent the mining means for circulation an atmosphere, with an oxygen concentration lower than required for explosion, at least at the forward end of a formed drive. The drive is closed off with barrier means to restrict gas flow into and from the drive. The inertization gas can be selected from one or more of, inert combustion gases, nitrogen and carbon dioxide and is fed to the forward end of the drive via a conduit wound up on a reel located outside the drive. This system can reduce the risk of explosions occurring in highwall mining. A disadvantage of the prior art inertization system for highwall mining is that it is time consuming in use, expensive and only suited for traditional highwall mining to restricted depths. Furthermore the prior art system is also vulnerable (e.g. to rock fall).

The present invention has for its object to provide a system, segment and method for reducing the risk of explosion in highwall mining that is more efficient in use.

The invention provides for this purpose a highwall mining system comprising: a cutterhead, a train of conveyor segments connecting to the cutterhead, a base structure connecting to the train of conveyor segments opposite the side connecting to the cutterhead, and a gas feed running from the base structure to the cutterhead for guiding inert gas to the environment of the cutterhead, characterised in that at least one of the conveyor segments comprises a channel that is incorporated in the gas feed. The cutterhead is normally formed by rotatable mining means for cutting coals from the seam to form a drive in the seam. The cutterhead is connected to the base structure (also known as a "launch platform" in combination with a separate power generating unit providing the power for the launch platform and connected via power and control cables to the launch platform) with an increasing number of conveyor segments (units) while progressing deeper in a seam. According the present invention the gas feed for inert gas is automatically provided by connecting the conveyor segments; the channel (e.g. a tube, pipe, tubing and/or conduit) for feeding the inert gas is integrated with the conveyor segments. This makes a loose conduit in combination with a reel superfluous. The advantages of a channel integrated with at least one conveyor segment, but preferably all the conveyor segments between the cutterhead and the base structure, are that there is no conduit that has to be handled and can be damaged. The channel integrated with the conveyor segment (e.g. in the conveyor segment or at least partially surrounded by the conveyor segment) has the advantage that it reduces the risk for damaging the gas feed and it also reduces the risks of other interference of the conduit with the environment. Another important advantage is that the prior art type of gas feed can only be operated to a restricted length of the shaft (to typically approximately 300 meters) as a reel can only hold a restricted length of conduit. The present invention also enables to work with longer shaft lengths and is thus more flexible in use.

As the adjoining conveyor segments comprise preferably releasable connected tubes for guiding inert gas the coupling and uncoupling of adjoining conveyor segments leads automatically, so without any extra attention of an operator outside the normal coupling/uncoupling routine, to adaptation of the required length of the gas feed. When the releasable connected tubes of adjoining conveyor segments are pivotably coupled the chances of damaging the couplings are further restricted and the flexibility in coupling and uncoupling is enhanced. Another advantage of pivotably coupling is that a train of conveyor segments can have a shaped that differs from a straight line. A good gas tight (or at least substantially gas tight) coupling of adjoining channels can be provided when the tubes of adjoining conveyor segments are connected with an intermediate inflatable sealing or sealing with similar characteristics.

A cheap supply of inert gas can be provided by connecting the gas feed for feeding inert gas to the environment of the cutterhead to the exhaust of an combustion engine that is part of the base structure, preferably with an intermediate conditioning unit (e.g. a filter). As explained before the base structure can be a combination of separate units (e.g. a "launch platform" and a separate power generating unit). The conditioning unit is to be used to condition the exhaust of for instance a generator that is part of the base structure. The advantage of reusing exhaust gasses is that it is economical and that it is environmental friendly. The exhaust gasses normally contain soot and other unwanted components like $H_2O$, $SO_3$ and $SO_4$. Also the temperatures of the exhaust gasses can be high (typically approximately 400° C. for a generator in the base structure). The conditioning unit ideally reduces the content of unwanted components and reduces the temperature of at least a part of the flow of exhaust gasses. The at least partly removal of larger particles from the combustion gasses can be realised by a conventional filter system and/or a centrifugal separator. Furthermore it is preferred that the conditioning unit is not influencing the combustion engine (turbine) it is connected to by influencing the back pressure of the engine. For this reason the conditioning unit may also comprise a compressor to enhance the pressure of the exhaust gasses internal the conditioning unit during and/or after passing the selection and cooling segments. Such an extra compressor minimises the power consumption of the base structure and makes it possible to transport the conditioned exhaust gasses over relative long distances. For further transportation of the conditioned exhaust gasses it is experienced to be favourable if the pressure of the gasses leaving the conditioning unit is up to 2 bar and the temperature is maximally 25° C. above ambient temperature. Such a temperature in combination with the removal of undesired components from the exhaust gas will make that damage to the conveyor segments and the cutterhead due to e.g. the creation of acid condensation in the system will not occur and so channels, channel couplings, coolers, compressors, control valves and any other parts of the system that come in contact with the conditioned exhaust gas will be less polluted during use.

The invention also provides a conveyor segment for use in a train of conveyor segments of a highwall mining system, characterised in that the segment comprises a gas channel for the transportation of an inert gas. The gas channel can be incorporated in the frame of the conveyor segment and is preferably longitudinally positioned in (or on) the conveyor segment. A further preferred embodiment is characterised in that the length of the gas channel of a conveyor segment substantially corresponds with the length of the conveyor segment. For cooperation with adjacent conveyor segments at least one of the open sides of the gas channel can be provided with coupling means for close fitted coupling of adjacent gas channels. A gas tight coupling of gas channels can be realised with inflatable coupling means or other means that provide similar sealing characteristics, e.g. means that make use of the pressure in the gas channels. For a further disclosure of the advantages of such a conveyor segment reference is made to the highwall mining system according to the present invention.

In a further preferred embodiment at least one of the sides of the gas channel is provided with a closure, e.g. a one way valve, lid, or flap. Such a closure can prevent that inert gas flow away from a channel in a train of conveyor segments and/or that air flows in train of conveyor segments when the train is disconnected from the base structure when coupling a new segment to the train or when uncoupling a conveyor segment from the train. It is advantageous if the closure leaves the gas channel free or almost free when the gas channel is coupled to an adjoining gas channel.

The invention further relates to a method for providing a highwall mining system that creates a substantially inert atmosphere for a cutterhead of the mining system, by providing a channel from an exhaust of a combustion engine that is part of a base structure of the mining system to the environment of the cutterhead, which cutterhead is separated from the base structure by a train of conveyor segments, characterised in that the channel for transportation of the inert gas is provided with the coupling of the conveyor segments, by coupling of channel parts integrated with the conveyor segments. The channel is provided simultaneously with the coupling of the conveyor segments as the coupling of the segments preferably automatically and without any extra effort leads to the coupling of channel parts. As already explained before it is also advantageous to place a conditioning unit between the combustion engine and the channel. If and when the channel parts are provided with closures it is also possible that during coupling of adjacent channel parts of adjacent conveyor segments these closure means are opened without the need of any extra manipulation. For a further explanation of the terms base structure and conditioning unit see above.

Figure 2:
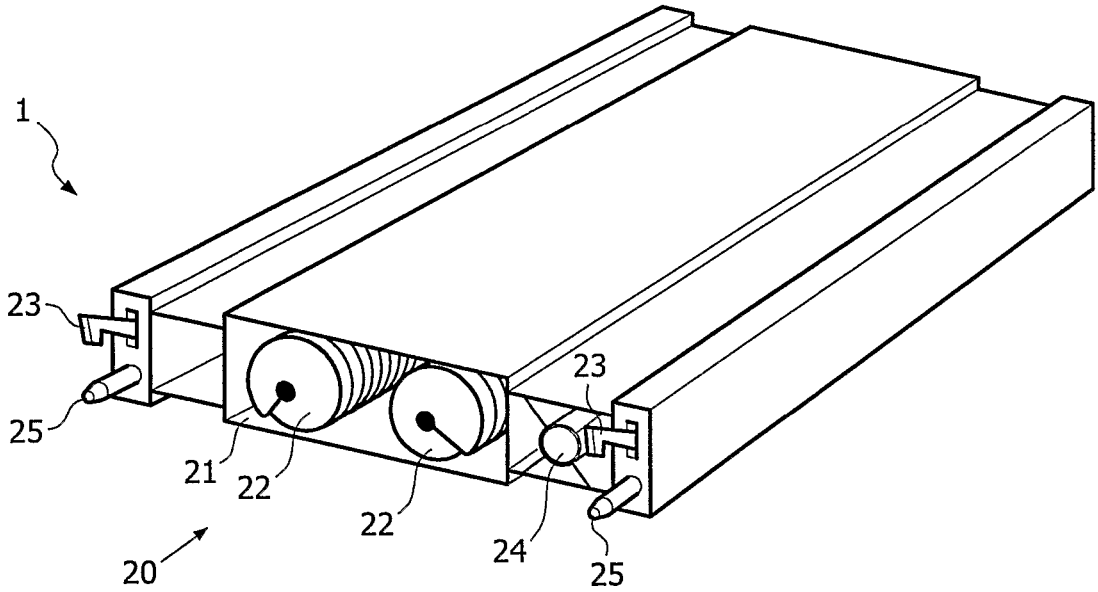
Figure 3:
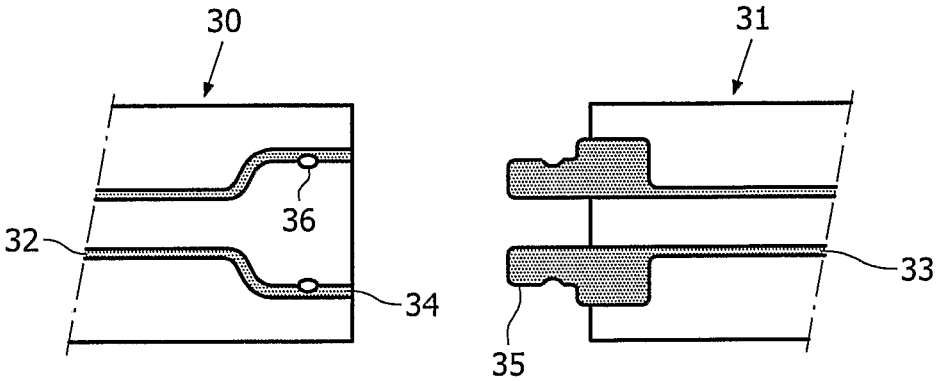
Figure 4:
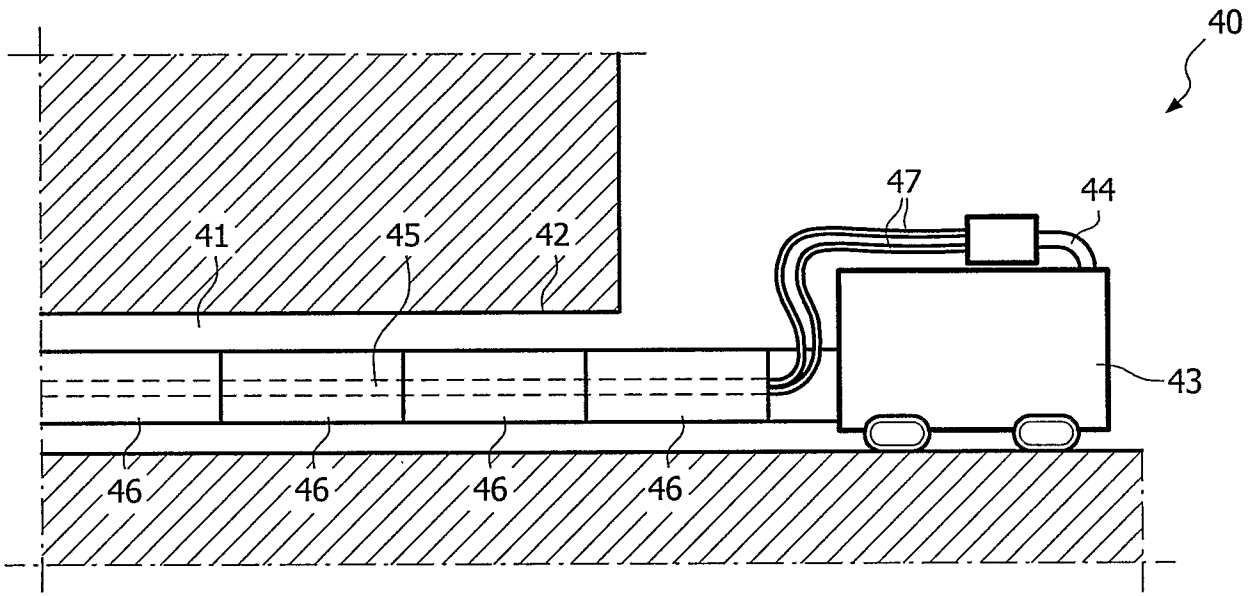
Figure 5A:
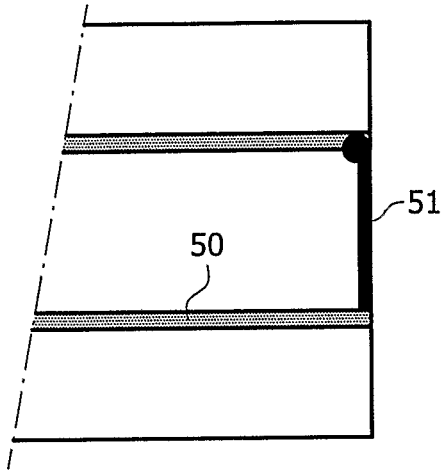
Figure 5B:
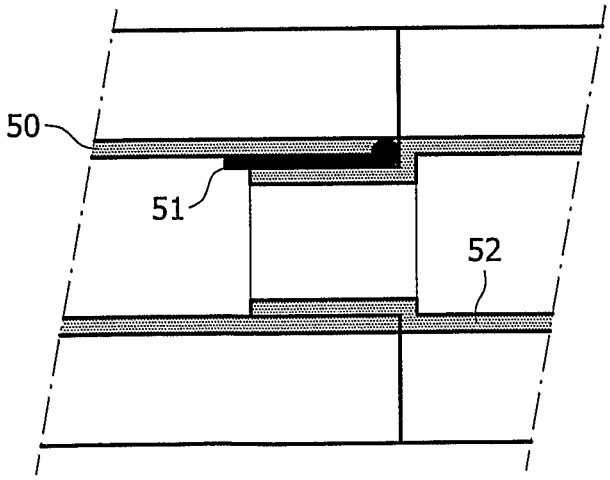

The invention will further be elucidated on the basis of non-limitative embodiments shown in the following figures. Herein:

FIG. 1 shows a schematic view on a highwall mining system according the present invention, FIG. 2 shows a perspective view on a conveyor segment according the invention, FIG. 3 shows a cross section of two parts of conveyor segments to be coupled, FIG. 4 shows a schematic view on a part of a highwall mining system with an alternative coupling of a gas feed to a launch platform, FIG. 5A shows a cross section of two parts of conveyor segments to be coupled with a closed off gas feed, and FIG. 5B shows a cross section of the two parts of conveyor segments as shown in FIG. 5A in a coupled position with an opened off gas feed.

FIG. 1 shows a general view on an highwall mining system 1 having a cutterhead 2 that is cutting a substantial horizontal shaft 3 in an overburden 4. The cutterhead 2 is coupled to a launch platform 5 with intermediate conveyor segments 6. A exhaust 7 of the launch platform 5 feeds the inert gasses according arrow $P_1$ from a, not shown, combustion engine in the platform 5 to a conditioning unit 8. After being conditioned the combustion gasses are, according arrows $P_2$, fed to a channel 9 that is incorporated in a train of conveyor segments 6. The inert exhaust gasses are led by the channel, according arrows $P_3$, to the environment of the cutterhead 2 where they lead the channel 9 according arrow $P_4$ thus reducing the risks of explosions due to e.g. coal dust, methane and/or mine gas. The overmeasure on inert gas (=purge amount) (partially the gas will substitute volume of the material removed from the shaft 3) will leave the open end of the shaft 3 according arrows $P_5$.

FIG. 2 shows a perspective view on a conveyor segment 20 with a central transport path 21 for mining material like coal or minerals provided with two rotatable screw conveyors 22. The conveyor segment 20 is also provided with a pipe 24 for feeding inert gasses in the opposite direction than the transport direction of the screw conveyors 22. The conveyor segment 20 is furthermore provided with coupling hooks 23 and guiding pins 25 for cooperation with another conveyor segment 20. The guiding pins 25 fit in holes of an opposite conveyor segment 20 and only after the guiding pins are in these opposite holes the conveyor segments 20 are in line. By subsequently latching the coupling hooks 23 the conveyor segments are completely coupled.

FIG. 3 shows in cross section a part of two conveyor segments 30, 31 with pipes 32, 33 both provided with a coupling part 34, 35. The coupling part 35 can be inserted in the coupling part 34 and for a gas tight connection the coupling 34 is provided with an inflatable sealing ring 36. The sealing ring can alternatively also be located at the male coupling part 35.

FIG. 4 shows a part of an alternative embodiment of a general view on an highwall mining system 40 cutting a substantial horizontal shaft 41 in an overburden 42. A launch platform 43 with has an exhaust 44 feeding conditioned combustion gasses to a channel 45 that is incorporated in a train of conveyor segments 46. The exhaust gasses a guided through a plurality of flexible hoses 47 with a limited diameter to the channel 45 that has a larger diameter than the individual flexible hoses 47. This transition from a plurality of flexible hoses 47 to the single (inflexible) channel 45 is a reliable construction providing both a flexible coupling between the launch platform 43 an the train of conveyor segments 46 without problems in relation to the resistance of the coupling.

FIG. 5A shows in cross section a part of a pipe segment 50 for the transportation of inert gas provided with a valve 51 that closes off the pipe segment 50 in a situation the pipe segment is not coupled to another pipe segment. In FIG. 5B the same pipe segment 50 is coupled with a second pipe segment 52 due to the coupling of both pipe segments 50, 52 the valve 51 is automatically opened to leave a free passage for inert gasses.

The invention claimed is:

1. Highwall mining system comprising:

a cutterhead, a train of conveyor segments connecting to the cutterhead, a base structure connecting to the train of conveyor segments opposite the side connecting to the cutterhead, and:

a gas feed running from the base structure to the cutterhead for guiding inert gas to the environment of the cutterhead, wherein at least one of the conveyor segments comprises a channel that is incorporated in the gas feed, wherein adjoining conveyor segments comprise releasable connected tubes for guiding inert gas.

2. Highwall mining system according claim 1, wherein the tubes of adjoining conveyor segments are connected with an intermediate inflatable sealing.

3. Highwall mining system according to claim 1, wherein the gas feed for feeding inert gas to the environment of the cutterhead is connected to the exhaust of a combustion engine that is part of the base structure.

4. Highwall mining system according claim 3, wherein the gas feed is connected to the combustion engine with an intermediate conditioning unit.

5. Conveyor segment for use in a train of conveyor segments of a highwall mining system, wherein the segment comprises a gas channel having at least two sides for the transportation of an inert gas, and wherein the gas channel is incorporated in the frame of the conveyor segment, and wherein at least one of the sides of the gas channel is provided with a closure.

6. Conveyor segment according to claim 5, wherein the gas channel is longitudinally positioned in the conveyor segment.

7. Conveyor segment according to claim 5, wherein the length of the gas channel of a conveyor segment substantially corresponds with the length of the conveyor segment.

8. Conveyor segment according to claim 5, wherein at least one of the open sides of the gas channel is provided with coupling means.

9. Conveyor segment according to claim 5, wherein at least one of the open sides of the gas channel is provided with inflatable coupling means.

10. Conveyor segment according to claim 5, wherein the closure leaves the gas channel substantially free when the gas channel is coupled to an adjoining gas channel.

11. Method for providing a highwall mining system that creates a substantially inert atmosphere for a cutterhead of the mining system, by providing a channel from an exhaust of a combustion engine that is part of a base structure of the mining system to the environment of the cutterhead, which cutterhead is separated from the base structure by a train of conveyor segments, wherein the channel for transportation of the inert gas is provided with the coupling of the conveyor segments, by coupling of channel parts integrated with the conveyor segments, wherein each conveyor segment comprises a channel part and at least one of the conveyor segments has closure means, and wherein during coupling of adjacent channel parts of adjacent conveyor segments the closure means of the at least one of the conveyor segment are opened.

12. Method according to claim 11, wherein a conditioning unit is placed between the combustion engine and the channel.

* * * * *